United States Patent [19]

Martin

[11] 4,057,178

[45] Nov. 8, 1977

[54] MATERIAL PLEATER

[76] Inventor: Edna Henderson Martin, 309 Oregon St., Birmingham, Ala. 35224

[21] Appl. No.: 750,133

[22] Filed: Dec. 13, 1976

[51] Int. Cl.[2] ..... A41H 43/00

[52] U.S. Cl. ..... 223/35

[58] Field of Search ..... 223/28–30, 223/33–36; 112/136, 131–135

[56] References Cited

U.S. PATENT DOCUMENTS

| | | | |
|---|---|---|---|
| 2,669,955 | 2/1954 | Gellman | 112/136 |
| 3,547,319 | 12/1970 | Ketchum | 223/28 |
| 3,726,449 | 4/1973 | Kern | 223/35 |
| 3,889,858 | 6/1975 | Hack | 223/35 |
| 3,957,182 | 5/1976 | Sambus | 223/35 |

*Primary Examiner*—G. V. Larkin

*Attorney, Agent, or Firm*—Woodford R. Thompson, Jr.

[57] ABSTRACT

A material pleater embodying a plurality of parallel, longitudinally extending plate-like members carried by an elongated member with adjacent plate-like members spaced from each other to receive a pleat of material therebetween. An elongated pleat depresser has longitudinally extending, spaced apart depresser elements with each being disposed to move between adjacent plate-like members and depress a pleat of material therebetween. Detachable means connects the pleats thus formed to each other whereby they remain in the formed position after removal of the plate-like members and the pleat depresser.

3 Claims, 5 Drawing Figures

MATERIAL PLEATER

BACKGROUND OF THE INVENTION

This invention relates to a material pleater and more particularly to such a device which shall be adapted to form pleats in draperies and the like formed of suitable material, such as cloth, plastic, paper and the like.

Heretofore in the art to which my invention relates, the formation of pleats, such as drapery pleats, required a considerable amount of time and effort due to the fact that it is very difficult to form the pleats uniformly by hand and then secure the pleats in place. This is especially true in view of the fact that the sections of material forming the individual pleats are easily moved relative to each other whereby the pleats are not of a uniform width throughout the entire length thereof. Also, difficulties have been encountered in securing the pleats in place due to the fact that it is very difficult to detachably connect the pleats to each other after they are formed by hand due to the fact that there is often slippage between the adjacent sections of material as the pleats are attached to each other.

SUMMARY OF THE INVENTION

In accordance with my invention, I provide a material pleater which embodies an elongated member having parallel, longitudinally extending plate-like members with adjacent plate-like members spaced from each other to receive a pleat of material therebetween. A pleat depresser having longitudinally extending, spaced apart depresser elements is adapted to move between adjacent plate-like members to thereby depress a pleat of material therebetween. Detachable means connects the pleats thus formed to each other so that upon movement of the plate-like member and the pleat depresser away from each other the pleats remain in the formed position.

DESCRIPTION OF THE DRAWING

A material pleater embodying features of my invention is illustrated in the accompanying drawing, forming a part of this application, in which.

DETAILED DESCRIPTION

Figure 2:
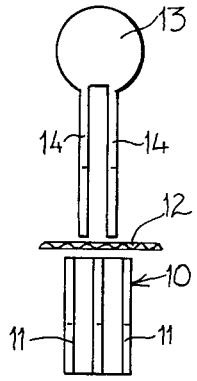
FIG. 2 is an end elevational view taken generally along the line 2—2 of FIG. 1.
Figure 4:
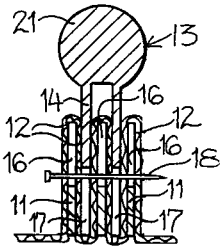
FIG. 4 is a sectional view taken along the line 4—4 of FIG. 3.

Referring now to the drawing for a better understanding of my invention, I show an elongated member 10 which comprises a plurality of parallel, longitudinally extending plate-like members 11, as shown in FIGS. 2 and 4. As shown in FIG. 4 each of the plate-like members is spaced from each other a distance to receive a pleat of the material, indicated at 12.

Figure 5:
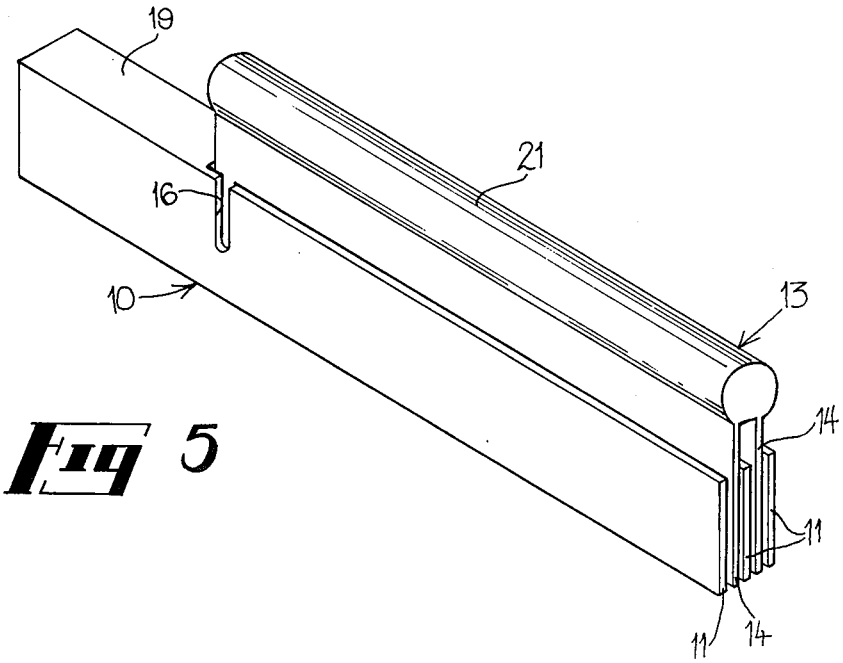
FIG. 5 is a perspective view showing the material pleater in the operative position with the material being omitted for the sake of clarity.

An elongated pleat depresser 13 is provided with longitudinally extending, spaced apart depresser elements 14 which are disposed to move between adjacent ones of the plate-like members 11, as shown in FIGS. 4 and 5, to thus depress a pleat of the material 12 between adjacent ones of the plate-like members 11.

Figure 1:
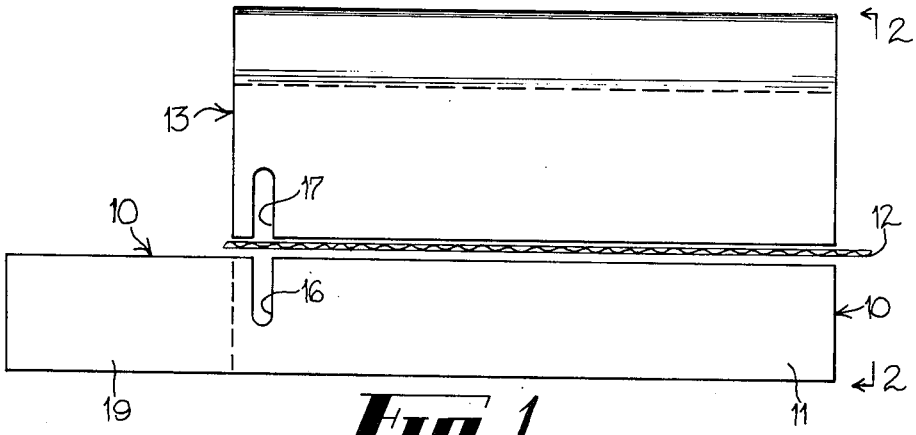
FIG. 1 is a side elevational view showing a sheet of material inserted between the plate-like members and the pleat depresser just prior to formation of the pleats.
Figure 3:
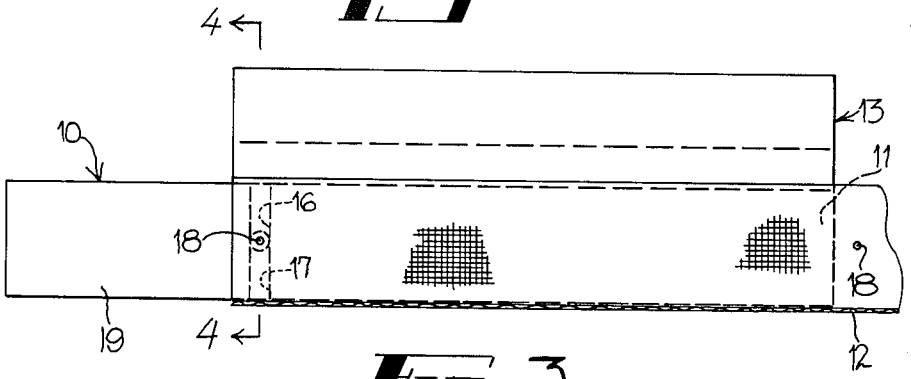
FIG. 3 is a side elevational view showing the material pleater in the operative position after the pleats have been formed and detachably secured in place.

The plate-like members 11 are provided with transversely aligned, outwardly opening slots 16 therein. In like manner, the depresser elements 14 are provided with transversely aligned, outwardly opening slots 17 therein. As shown in FIG. 1, the outwardly opening slots 16 and 17 face each other and are in transverse alignment with each other for receiving a securing member, such as a pin-like member 18, as shown in FIG. 4. That is, as the pleat depresser 13 and the elongated member 10 are moved to the position shown in FIG. 3, the outwardly opening slots 16 and 17 move to the position shown in FIGS. 3 and 4 whereby a through passageway is provided for receiving the pin-like member 18 so that the pleats thus formed are detachably connected to each other. The outwardly opening slots 16 and 17 are located adjacent one end of the plate-like members 11 and the adjacent end of the pleat depresser 13 whereby the formed pleats are detachably secured adjacent that end of the plate-like members 11 by the pin-like member 18. The pleats thus formed are secured adjacent the other end of the plate-like members 11 by a second pin-like member 18 which is adapted to pass through the pleats thus formed at a location outwardly of the ends of the plate-like members 11, as shown in FIG. 3.

Preferably, the elongated member 10 extends beyond the outwardly opening slots 16 to define a handle 19 for the elongated member 10. The upper portion of the pleat depresser 13 is preferably rounded throughout its length, as shown in FIGS. 2, 4 and 5, to provide a handle-like member for the pleat depresser. Accordingly, the handle members 19 and 21 facilitate relative movement of the pleat depresser and the elongated member relative to each other as the pleats are formed and as the elongated member 10 and the pleat depresser 13 are moved away from each other after formation of the pleats.

From the foregoing description, the operation of my improved material pleater will be readily understood. The sheet of material in which the pleats are to be formed is placed across the tops of the plate-like members 11, as shown in FIGS. 1 and 2, with one edge of the material 12 extending beyond the outwardly opening slots 16 and 17, as shown in FIG. 3. The other edge of the sheet of material 12 is not limited in length. With the sheet of material 12 thus positioned across the elongated member 10, the pleat depresser 13 is moved downwardly by hand to force the material 12 between adjacent ones of the plate-like members 11 whereby the sheet of material 12 assumes the shape shown in FIG. 4. After formation of the pleats in the material 12, a straight pin 18 is inserted through the material by inserting the pin through the aligned openings 16 and 17, as shown in FIGS. 3 and 4. A pin 18 is also inserted through the pleated material outwardly of the end of the elongated member 10 opposite the handle 19, as shown in FIG. 3. After thus securing the formed pleats in place by the pins 18, the pleat depresser 13 is lifted from the elongated member 10 and the elongated member 10 is lowered free of the material 12 with the pleats thus formed remaining in the formed position. Additional pleats may then be formed in the material 12 by repeating the above steps.

From the foregoing, it will be seen that I have devised an improved material pleater. By providing a plurality of longitudinally extending plate-like members which are spaced from each other a distance to receive the material 12 as it is depressed by the pleat depresser elements 14, all of the pleats fre formed in a uniform manner with a minimum of time and effort. Also, the pleats remain in the formed position until the pins 18 are inserted whereupon the plate-like members and the pleat depresser may then be removed for forming additional pleats. Also, by providing the outwardly opening slots 16 and 17, the ends of the pleats thus formed may be detachably connected to each other while the forming members 10 and 13 are still in place, thereby assuring that the pleats are of a uniform width and remain in the formed position after removal of the members 10 and 13.

While I have shown my invention in but one form, it will be obvious to those skilled in the art that it is not so limited, but is susceptible of various changes and modifications without departing from the spirit thereof.

What I claim is:

1. A material pleater comprising:

a. an elongated member, b. a plurality of parallel, longitudinally extending plate-like members carried by said elongated member with adjacent ones of said plate-like members spaced from each other to receive a pleat of said material therebetween, c. an elongated pleat depresser having longitudinally extending spaced apart depresser elements with each said depresser element being disposed to move between adjacent ones of said plate-like members and depress a pleat of said material therebetween to form pleats between said plate-like members, and d. there being transversely aligned outwardly opening slots in said plate-like members which are in transverse alignment with and face transversely aligned outwardly opening slots in said depressor elements for receiving means for detachably connecting said pleats thus formed to each other so that upon movement of said plate-like members and said pleat depresser away from each other said pleats remain in the formed position.

2. A material pleater as defined in claim 1 in which said means for detachably connecting said pleats to each other comprises at least one pin-like member of a size to pass through said transversely aligned openings in said plate-like member and said depresser elements with said transversely aligned openings being adjacent one end of said plate-like members.

3. A material pleater as defined in claim 2 in which said means for detachably connecting said pleats to each other also comprises a second pin-like member which is adapted to pass through the pleats thus formed at a location outwardly of the other end of said plate-like member.

* * * * *